US005630732A

United States Patent [19]

Yamanashi

[11] Patent Number: 5,630,732

[45] Date of Patent: May 20, 1997

[54] LIQUID-TIGHT CONNECTOR FOR ELECTRICAL WIRES

[76] Inventor: Makoto Yamanashi, c/o Yazaki Parts Co., Ltd., 206-1, Nunobikibara, Haibara-cho, Haibara-gun, Shizuoka, Japan

[21] Appl. No.: 494,521

[22] Filed: Jun. 26, 1995

[30] Foreign Application Priority Data

Jun. 30, 1994 [JP] Japan ..... 6-149915

[51] Int. Cl.[6] ..... H01R 13/40

[52] U.S. Cl. ..... 439/589; 439/936

[58] Field of Search ..... 439/736, 936, 439/587, 589, 206; 29/883

[56] References Cited

U.S. PATENT DOCUMENTS 3,922,477 11/1975 Glowacz ..... 439/589
4,214,802 7/1980 Otani et al. ..... 439/589
4,693,534 9/1987 Clark ..... 439/736
5,278,357 1/1994 Yamanashi ..... 439/936

FOREIGN PATENT DOCUMENTS 62-49877 3/1987 Japan .

*Primary Examiner*—Neil Abrams
*Assistant Examiner*—Barry Matthew L. Standig

[57] ABSTRACT

Pressure-escape holes of a housing closed by a rubber plug and sealed by injection of molten filler are made to communicated with terminal reception rooms through notches. The pressure generated during injection of the filler, when the air in the pressure-escape holes expands can escape into the terminal reception rooms so as to prevent the rubber plug from being inclined, and prevent the filler from leaking outside the housing.

3 Claims, 3 Drawing Sheets

LIQUID-TIGHT CONNECTOR FOR ELECTRICAL WIRES

BACKGROUND OF THE INVENTION

1. Field of the Invention

The present invention relates to a connector for connecting electric wires to each other, and more particularly relates to a connector attached to a through hole provided in a casing filled with a liquid, for connecting electric wires disposed inside the casing with electric wires disposed outside the casing.

2. Related Art

In an automatic transmission of a car, electric wires of solenoid valves, various sensors and so on disposed inside a transmission casing, for controlling a speed change gear, are connected to a control unit disposed outside the transmission casing through a connector attached to a through hole provided through the transmission casing.

However, the transmission casing is filled with oil for lubricating the speed change gear. Therefore, the connector must be structured to such that the wires disposed inside and outside the transmission casing can be connected to each other without the oil leaking to the outside of the transmission casing.

SUMMARY OF THE INVENTION

It is therefore an object of the present invention to prevent a rubber plug from being inclined in a rubber plug mounting portion by the expanding pressure of the air due to the heat in or after injecting a filler to perfectly fill the gaps between the inner wall of a housing, terminals and wires.

The foregoing object of the present invention can be attained by a connector comprising a housing, terminals mounted in the housing, a filler in a molten state injected into gaps between the terminals and the housing to fill up the gaps liquid-tightly, and a sealing member attached inside the housing to seal the housing so as to prevent the filler from leaking out of the housing when the filler is injected into the housing; wherein ribs projecting inside the housing are provided in the housing to position the sealing member, and holes for pressure escape are formed in the ribs, and communication means are provided in the holes so as to make the holes communicate with spaces to be filled with the filler when the sealing means is mounted in the housing.

In the connector according to the present invention, a space inside a pressure-escape hole of a housing closed by a sealing member is communicated with a space to be filled with a filler. Accordingly, the air in the pressure-escape hole can move into the space on the filler side even if the air expands.

Accordingly, when the air in the pressure-escape hole expands, the expanding pressure escapes to the filler side having fluidity so that there is no fear that a rubber plug or the like which is a sealing member is urged to be inclined inside the housing.

DETAILED DESCRIPTION OF THE PREFERRED EMBODIMENTS

The preferred embodiments of the invention will be now described with reference to the drawings.

First Embodiment

Figure 4:
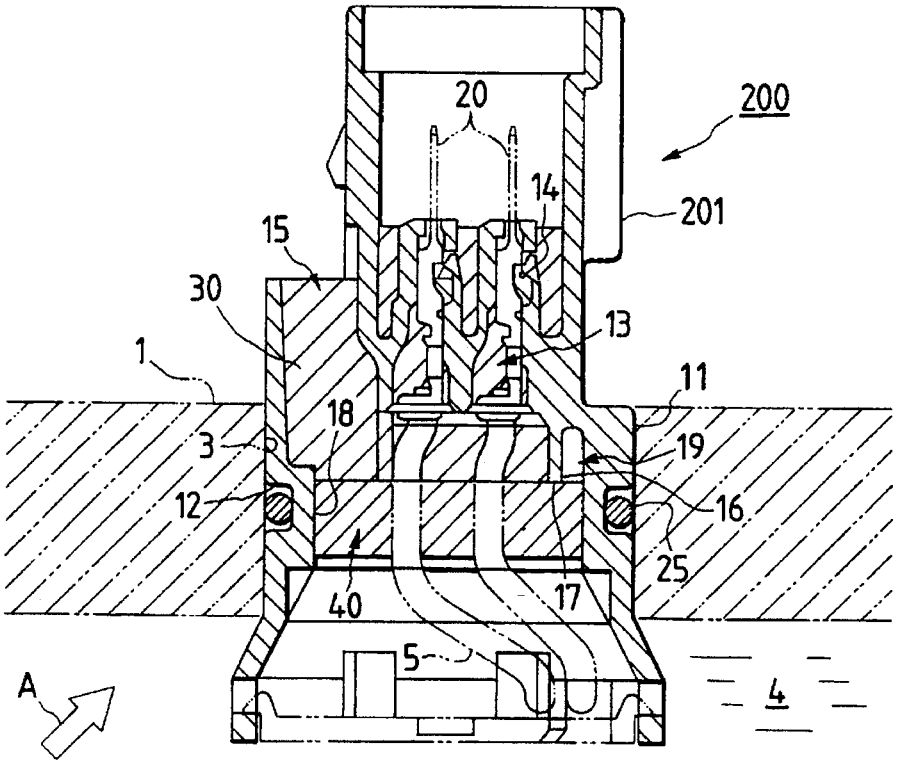
FIG. 4 is a whole longitudinally sectional view of a housing of a connector of a first embodiment of the present invention.
Figure 5:
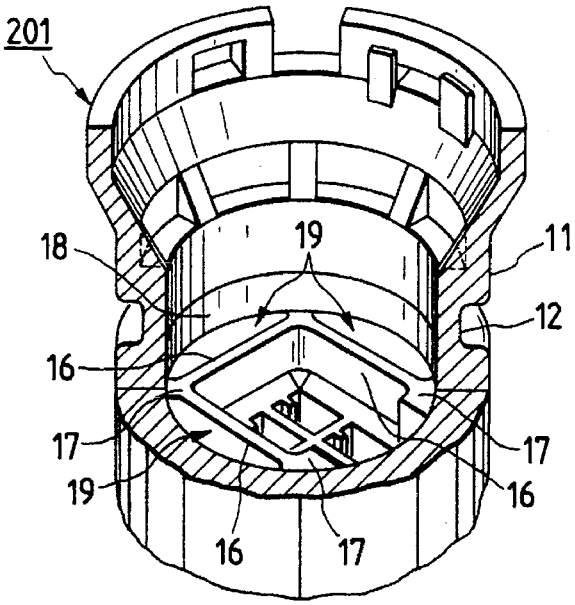
FIG. 5 is a partially broken perspective view when viewed in the direction of arrow A shown in FIG. 4.

A connector 200 as shown in FIG. 4 according to a first embodiment of the present invention will now be described, This connector 200 has a housing 201, terminals 20 mounted in the housing 201, a filler 30 injected into gaps among the terminals 20 and the housing 201 to fill the gaps liquid-tightly, and a rubber plug 40 as a sealing member attached inside the housing 201 for sealing the housing 201 so as to prevent the filler 30 from leaking from the housing 201 when the filler 30 is injected into the housing 201.

This housing 201 is integrally formed from a resin material by injection molding. In the housing 201, an O-ring 25 is attached in a concave groove 12 provided so as to extend circumferentially in the outer circumferential surface of a fitting portion 11 formed approximately cylindrically.

When the fitting portion 11 of the housing 11 is fitted in a through hole 3 provided so as to pass through a transmission casing 1, a locking nail (not shown) formed integrally with the housing 201 is engaged with the outside surface of the transmission casing 1 to prevent the housing 201 from being detached, and at the same time the O-ring 25 is brought into tight contact with the housing 201 and the inner circumferential surface of the through hole 3 to prevent oil 4 filling the inside of the transmission casing 1 from leaking to the outside through a gap between the housing 201 and the wall of the though hole 3.

A plurality of terminals 20 connected to wires 5 led out from a control apparatus (not shown) disposed inside the transmission casing 1 are received in terminal reception rooms 13 of the housing 201. The terminals 20 are prevented from coming off by lances 14 molded integrally with the housing 201. The wires 5 are passed through through holes 41 which penetrate the rubber plug.

The filler 30 may be formed from any resin, for example, either thermoplastic resin or thermosetting resin, so long as it is in a molten state at the time of injection, and hardens after the injection. If filler 30 is injected inside the housing 201 through an inlet 15 of the housing 201 positioned so as to extend in the up/down direction as shown in FIG. 4, the filler 30 enters also into gaps between the inner wall of the housing 201, the terminals 20 and the wires 5, and hardened gradually as it is cooled in the case of thermoplastic resin, or hardened by heating at a specific temperature in the case of thermosetting resin.

If the filler 30 is hardened perfectly, the filler 30 fills the gaps between the inner wall of the housing 201, the terminals 20 and the wires 5 liquid-tightly to prevent the oil 4 in the transmission casing 1 from leaking to the outside through the inside of the housing 201.

The rubber plug 40 is disc-like and formed from a rubber material having heat resistance. Being brought into tight contact with end faces 17 of ribs 16 provided in end portions of the terminal reception rooms 13 of the housing 201 so as to be positioned in the axial direction, the rubber plug 40 is fitted into a rubber plug mounting portion 18 provided inside the housing 201, so that the rubber plug 40 can block the leakage of the filler 30 to the outside of the housing 201 when the filler 30 is injected into the housing 201.

Second Embodiment

In this embodiment, portions the same as those in the first embodiment are referenced correspondingly and will not be described in detail.

Figure 3:
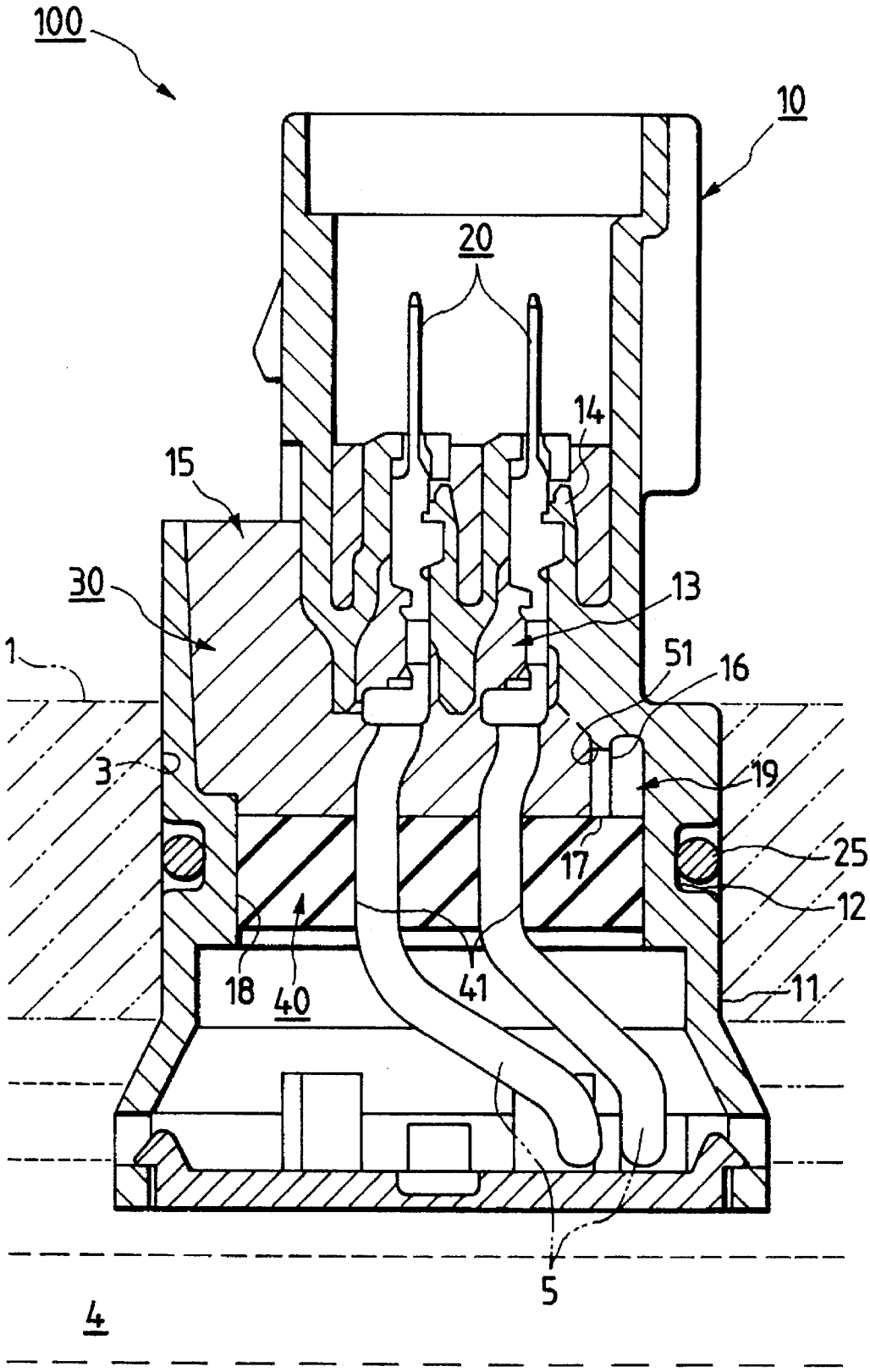
FIG. 3 is a schematic longitudinal sectional view illustrating the connector according to the present invention as mounted.

Referring to FIG. 3, a connector 100 of this embodiment is the same as the housing of the above-mentioned conventional connector, except that spaces inside pressure-escape holes 19 provided in a housing 10 communicate with terminal reception rooms 13 as spaces to be filled with a filler 30.

Figure 1:
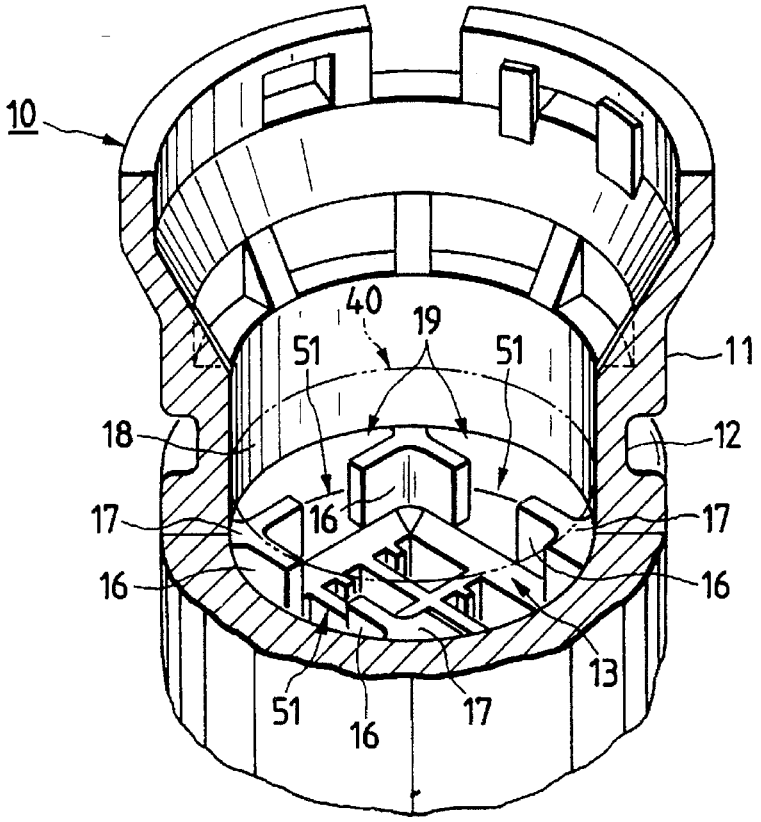
FIG. 1 is a partially broken perspective view illustrating a main portion of a housing of a connector of an embodiment of the present invention.
Figure 2:
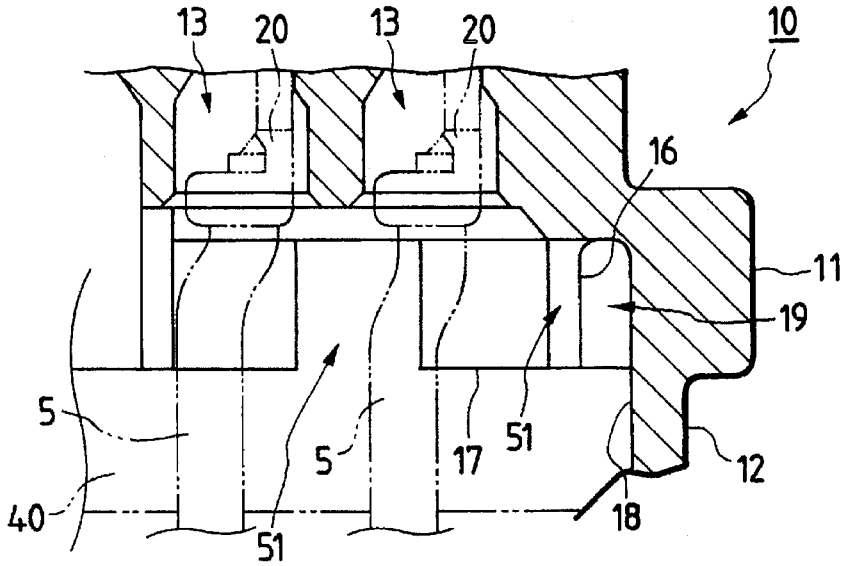
FIG. 2 is an enlarged sectional view illustrating the main portion of the housing shown in FIG. 1.

Therefore, only this portion of the connector will be described. In the housing 10 according to the present invention, as shown in FIG. 1, a rubber plug 40 is attached so as to come into tight contact with end faces 17 of ribs 16, and notches 51 are formed in the respective ribs 16 so as to extend from the end faces 17 of the ribs 16 to the inlets of terminal reception rooms 13 so that the notches 51 act as communication means. Accordingly, spaces inside the pressure-escape holes 19 can communicate with the terminal reception rooms 13 when the rubber plug 40 is mounted in the housing.

Thermosetting resin is used as a filler 30 in this embodiment. The resin, in a liquid phase, is injected from an inlet 15, and thereafter the filler 30 is hardened by a method in which the connector 100 is put in a constant temperature oven or a method in which infrared rays are radiated while the connector 100 is carried along a carrying line or the like; that is, heat energy is applied from the outside.

The heat applied to harden the filler 30 expands the air in the pressure-escape holes 19. However, the expanding pressure of this air escapes to the not-yet hardened filler 30 side. Therefore, the pressure of the expanded air in the pressure-escape holes 19 does not become large enough to incline the rubber plug 40. It is therefore possible to avoid the inclination of rubber plug 40.

As a result, there is no fear that the filler 30 will leak to the outside from between the rubber plug 40 and the wall of a rubber plug mounting portion 18. It is therefore possible to fill the gaps between the inner wall of the housing 10, terminals 20 and wires 5 perfectly, so that there is no fear that oil 4 in a transmission casing 1 leaks to the outside of the transmission casing 1 through the inside of the connector 100 when the connector 100 having this housing 10 is attached to a through hole 3 of the transmission casing 1.

Although the pressure-escape holes 19 provided adjacent to the terminal reception rooms 13 of the housing 10 were described in the above embodiment, the present invention is not always limited to form shown in the drawings, but pressure-escape holes having any form may be used as long as they can be closed by the rubber plug 40.

Although the notches 51, as the communication means for communicating the spaces in the pressure-escape holes 19 with the terminal reception rooms 13, were provided in all the ribs 16 in three positions defining the pressure-escape holes 19 in the above embodiment, the communication means according to the present invention is not limited to this notch structure, but any communication means having another structure such as holes or the like may be used.

Although the communication means was formed in all the three ribs 16 defining the pressure-escape holes 19 in the above embodiment, the present invention is not limited to this structure, but such a structure can be used in which the three pressure-escape holes 19 are made to communicate with each other, and only one of the pressure-escape holes 19 of the respective ribs 19 is made to communicate with the terminal reception rooms 13.

Although thermosetting resin was used as the filler in the above embodiment, thermoplastic resin may also be used as the filler.

In the connector according to the present invention, even if the air in the pressure-escape holes is expanded by the heat when the filler is injected into the housing or when the filler is heated, the expanding pressure escapes, and is applied to the liquid filler. Accordingly, the air pressure applied to the sealing member in the pressure-escape holes can be reduced, so that there is no fear that the sealing member will be inclined and the filler will leak outside the housing.

Therefore, in the connector according to the present invention, it is possible to perfectly fill the gaps between terminals mounted in a housing and the inner wall of the housing with the filler. For example, in the case where this connector is attached to a through hole provided in a transmission casing of a car, it is possible to prevent oil in a speed change gear from leaking out through the inside of the connector.

What is claimed is:

1. A connector comprising:

a housing;

terminals mounted in said housing;

gaps between said housing and said terminals;

a filler, injected while in a molten state into said gaps to fill up said gaps such that said gaps are liquid-tight;

a sealing member attached inside said housing to seal said housing so as to prevent said filler from leaking out from said housing when said filler is injected into said housing;

ribs projecting inside said housing, said ribs provided in said housing to position said sealing member, and said ribs having pressure escape holes to prevent said sealing member from being displaced when or after said filler is injected into said gaps.

2. A connector as claimed in claim 1, further comprising:

means for communicating said pressure escape holes with spaces to be filled with said filler when said sealing member is positioned in said housing.

3. A connector as claimed in claim 2, wherein said means for communicating is provided with said ribs.

* * * * *